United States Patent [19]

Thompson

[11] Patent Number: 4,848,108

[45] Date of Patent: Jul. 18, 1989

[54] ANIMAL PELT STRETCHING AND DRYING DEVICE

[76] Inventor: Robert R. Thompson, 805 Cerro Gordo, Ackley, Iowa 50601

[21] Appl. No.: 162,285

[22] Filed: Feb. 29, 1988

[51] Int. Cl.[4] ..... C14B 1/26

[52] U.S. Cl. ..... 69/19.2

[58] Field of Search ..... 69/19, 19.1, 19.2, 19.3

[56] References Cited

U.S. PATENT DOCUMENTS

| | | | |
|---|---|---|---|
| 775,034 | 11/1904 | Grape | 69/19 X |
| 1,169,145 | 1/1916 | Gibson | 69/19.2 |
| 1,348,238 | 8/1920 | Payne | 69/19.2 |
| 1,755,118 | 4/1930 | Hollywood | 69/19.2 |
| 1,892,624 | 12/1932 | Nelson | 69/19.2 |
| 2,534,071 | 12/1950 | Schulz, Sr. et al. | 69/19.2 |
| 3,301,028 | 1/1967 | Perardi | 69/19.2 |

FOREIGN PATENT DOCUMENTS

| | | | |
|---|---|---|---|
| 343469 | 11/1921 | Fed. Rep. of Germany | 69/19.2 |
| 75571 | 1/1918 | Switzerland | 69/19.2 |

*Primary Examiner*—Wm. Carter Reynolds
*Attorney, Agent, or Firm*—G. Brian Pingel

[57] ABSTRACT

An animal pelt stretching and drying device that is adjustable for use with differently sized animal pelts includes a pair of spaced apart elongated side members and an inverted "V"-shaped top member that is adjustably attached to the side members to vary the distance the top member extends above the side members. Also, at least one cross arm member is associated with the side members for controlling the spacing therebetween and can also be adjusted to vary the position of the cross arm member with respect to the upper portions of the side members.

4 Claims, 1 Drawing Sheet

ANIMAL PELT STRETCHING AND DRYING DEVICE

BACKGROUND OF THE INVENTION

1. Field of the Invention

The present invention relates in general to animal pelt stretching and drying devices and more specifically to such devices that are adjustable for use with differently sized animal pelts.

2. Description of the Prior Art

Pelt stretching and drying devices have been long known in the art and a wide variety of types of designs have been disclosed for such devices. Typically, known devices have either been formed from wood, or from metal; for example, see U.S. Pat. Nos. 1,169,145; 1,755,118; 3,301,028 and Re. 16,434.

To eliminate the need to have a stretcher for each size of animal pelt to be processed, it is also been known in the art to provide devices that can be adapted to be used with differently sized pelts. For example, in U.S. Pat. Nos. 1,169,145 and 1,755,118 stretching devices are disclosed that include structures for changing the configuration of the top ends of the stretchers to make them usable with differently sized animals, and an adjustable cross member is employed that can be varied in its distance from the top portion thereof. Although the above-described prior art devices provide some flexibility in the size of pelt that can be processed, they are relatively complex in construction and do not appear to provide for processing a wide range of pelt sizes.

The present invention provides an improved pelt stretching and drying device that can be adjusted to accommodate a wide range of pelt sizes and yet is relatively simplified in construction and adjustability.

SUMMARY OF THE INVENTION

The present invention provides an animal pelt stretching and drying device adjustable for use with differently sized animal pelts. The device includes a pair of spaced apart elongated side members and an inverted "V"-shaped top member that is adjustably attachable to the side members to vary the distance the top member extends above the side members. At least one cross member is associated with the side members for controlling the spacing therebetween, and means are included for varying the adjustment of the cross member with respect to the upper portions of the side members.

The inverted "V"-shaped top member is formed with two side arms that converge at a vertex. Preferably, the upper portions of the side members each have an axially aligned slot into which one of the side arms of the top member is received when said member is attached to the side members. Also, the free ends of the side arms of the top member each include a threaded boss, and the side members include axially spaced apart throughbores for receiving the threaded bosses for adjustment of the top member with respect to the side members.

DETAILED DESCRIPTION OF THE PREFERRED EMBODIMENT

Figure 1:
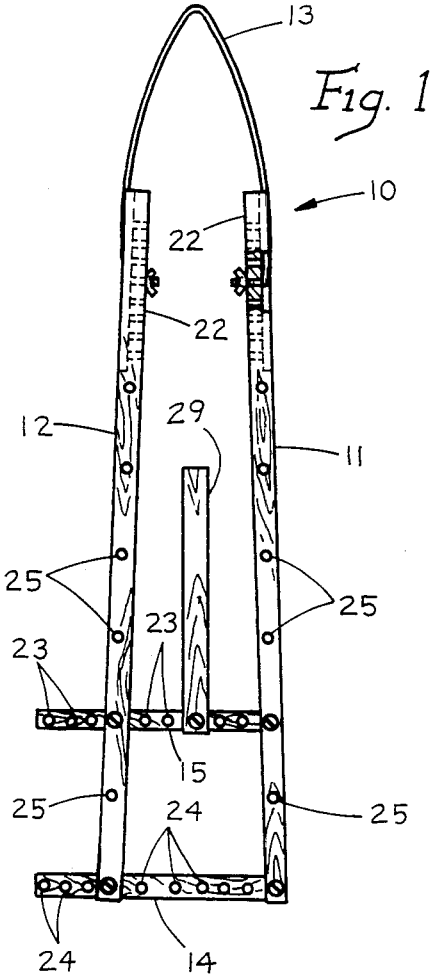
FIG. 1 is a front view of a preferred embodiment of an animal pelt stretching and drying device of the present invention and having a portion broken away for purposes of illustration.

Referring now to the drawings, and with reference first to FIG. 1 a preferred embodiment of a pelt stretching and drying device of the present invention is shown at 10 and is adapted to be usable for processing a wide variety of differently sized animal pelts. The device 10 includes a pair of elongated side members 11 and 12, an inverted "V"-shaped top member 13 and lower and upper cross members 14 and 15.

Figure 3:
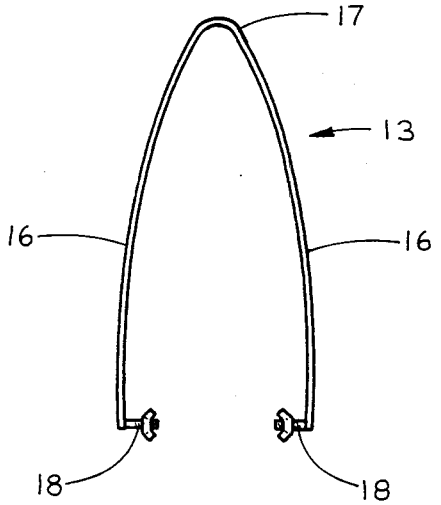
FIG. 3 is a front view of an inverted "V"-shaped top member that forms part of the preferred embodiment.

The side members 11 and 12 are essentially mirror images of one another and are preferably formed from wood but may be as well formed from metal or high strength plastic. Referring to FIG. 3, the inverted "V"-shaped top member 13 is preferably formed of a unitary construction from a resilient metal or high strength nylon rod that includes a pair of side arms 16 converging at a vertex 17. Because of the high resiliency of the member 13, the side arms 16 may be yieldably forced toward one another and yet will provide a relatively stiff construction to support a pelt attached thereon. The free ends of the top member side arms 16 preferably include inwardly directed threaded bosses 18 to be used for attachment of the member 13 to the side members 11 and 12 as will be described below.

Figure 2:
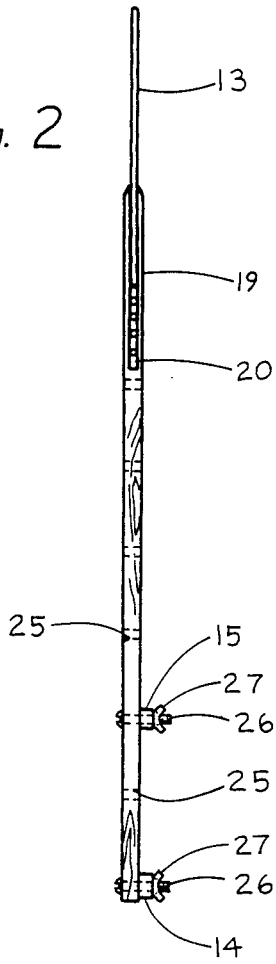
FIG. 2 is a side view of the device of FIG. 1.
Figure 4:
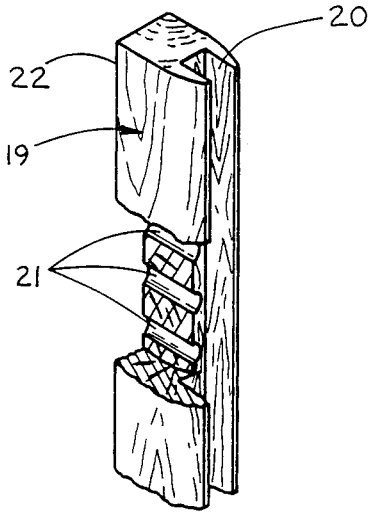
FIG. 4 is an enlarged top fragmentary portion of a side member forming a part of the device of FIG. 1 with a portion broken away for purposes of illustration.

The side members 11 and 12 each include an upper portion 19, as shown in FIGS. 2 and 4, formed with a longitudinally extending channel 20 for receiving the side arms 16 of the member 13. Also, a plurality of longitudinally spaced apart throughbores 21, as best seen in FIG. 4, extend from the bottom of the channels 20 to the inner surface 22 of the side members 11 and 12 for receiving the bosses 18 of the top member 13. Thus, the top member 13 can be adjustably positioned with respect to the side members 11 and 12 by choosing the particular pair of throughbores 21 into which the bosses 18 will be positioned to vary the position of the top member vertex 17 with respect to the upper portions 19 of the side members 11 and 12. In this way, the device 10 can be adjusted to accommodate various sizes of animal pelts that will have different lengths between the head and the shoulder portion of the pelts.

Referring now to FIGS. 1 and 2, the upper cross member 15 has a plurality of longitudinally spaced apart apertures 23, and in similar fashion, the lower cross member 14 has apertures 24. Also, the side members 11 and 12 have longitudinally spaced apart apertures 25. Preferably the cross members 14 and 15 are attachable to the side members 11 and 12 by the use of bolts 26 positioned through the apertures 25 and associated wingnuts 27. Variation of the distance between the side members 11 and 12 is accomplished by the choice of apertures 24 in the lower cross member 14 through which the bolts 26 are directed. Correspondingly, variation of the distance of the cross member 15 from the upper portions 19 of the side members 11 and 12 is accomplished by the choice of apertures 25 through which the bolts 26 are directed.

Although the lower portion of a pelt may be connected directly to the cross member 15, it is preferable to include a vertical support 29 extending upwardly from the cross member 15 for making such attachment. In this way, an additional variation in the size of pelt that can be processed by the device 10 is provided through the attachment of a pelt to the vertical member 29.

Thus, the present invention provides an improved pelt stretching and drying device adapted for permitting a user to process a wide variety of differently sized animal pelts. Although the construction of the present invention is relatively simple in form, the device can be readily adapted for the size of pelt to be processed.

Although two cross members 14 and 15 are disclosed herein it should be apparent to one skilled in the art that the concept of the present invention could as well be utilized through the use of only one cross member that will serve to control the spacing between the side members 11 and 12 and also provide a support for the vertical member 29.

I claim:

1. An animal pelt stretching and drying device adjustable for use with differently sized animal pelts comprising:

(a) a pair of spaced apart elongated side members;

(b) an inverted "V" shaped top member formed with two side arms that converge at a vertex;

(c) coacting means on said side members and said top member side arms for adjustably attaching said top member to one end portion of each of said side members so that the distance of the vertex of said top member from said side member end portions can be adjusted;

(d) a cross arm member associated with said side members for controlling the spacing therebetween;

(e) means for adjustably attaching said cross arm member to said side members to permit adjustment of the spacing between said side members;

(f) means for adjustably attaching said cross arm member to said side members to permit adjustment of the position of said cross arm member with respect to the upper portions of said side members; and (g) said coacting means are formed by the free ends of said side arms of said top member including threaded bosses and said side members including axially spaced apart throughbores for receiving said threaded bosses for adjustment of said top member with respect to said side members.

2. An animal pelt stretching device as recited in claim 1 wherein said device further includes means on said cross arm member for attaching a lower portion of an animal pelt to be stretched and dried to said device.

3. An animal pelt stretching device as recited in claim 1 wherein the upper portions of said side members each have an axially aligned slot into which one of the side arms of said top member is received when said top member is attached to said side mebers.

4. An animal pelt stretching device as recited in claim 1 wherein said top member is formed from a high strength resilient material.

* * * * *